US011974625B1

(12) United States Patent
Smith et al.

(10) Patent No.: US 11,974,625 B1
(45) Date of Patent: May 7, 2024

(54) HAT ATTACHABLE FACE MASK

(71) Applicants: Jefferson L. Smith, Denton, TX (US); Roger Hall, Denton, TX (US)

(72) Inventors: Jefferson L. Smith, Denton, TX (US); Roger Hall, Denton, TX (US)

( * ) Notice: Subject to any disclaimer, the term of this patent is extended or adjusted under 35 U.S.C. 154(b) by 163 days.

(21) Appl. No.: 17/540,775

(22) Filed: Dec. 2, 2021

Related U.S. Application Data

(60) Provisional application No. 63/120,507, filed on Dec. 2, 2020.

(51) Int. Cl.
*A42B 1/24* (2021.01)
*A41D 13/11* (2006.01)

(52) U.S. Cl.
CPC ..... *A42B 1/24* (2013.01); *A41D 13/1161* (2013.01)

(58) Field of Classification Search
CPC ..... A42B 1/24; A42B 1/018; A42B 1/0187; A41D 13/11–13/1192; A41F 1/002
See application file for complete search history.

(56) References Cited

U.S. PATENT DOCUMENTS 7,229,172 B2 * 6/2007 Presswood, Jr. ..... A42B 1/247 351/158
2020/0093212 A1 * 3/2020 Zheng ..... A42B 1/24
2021/0321726 A1 * 10/2021 Jourgensen ..... A62B 18/084
2021/0345702 A1 * 11/2021 Volk ..... A41D 13/11
2021/0361016 A1 * 11/2021 Pelletier ..... A42B 1/018
2022/0007759 A1 * 1/2022 Powell ..... A42B 1/24
2022/0022573 A1 * 1/2022 Hernandez ..... A42B 1/018
2022/0053864 A1 * 2/2022 Kim ..... A41D 13/1161
2022/0142281 A1 * 5/2022 Kuenzler ..... A42B 1/24
2022/0151315 A1 * 5/2022 Hugenberg ..... A42B 1/241
2022/0312868 A1 * 10/2022 Holliday ..... A62B 23/025

FOREIGN PATENT DOCUMENTS

DE 202016104637 U1 * 12/2016 ..... A44C 5/208
DE 202020004635 U1 * 12/2020
KR 20080026709 A * 3/2008
KR 200492759 Y1 * 12/2020

* cited by examiner

*Primary Examiner* — Amy Vanatta
(74) *Attorney, Agent, or Firm* — Kenneth L. Tolar

(57) ABSTRACT

A facemask attachable to a cap or hat eliminates the burden associated with separately transporting both items. The hat includes a crown portion with a sweatband circumferentially disposed on an inner surface. The face mask includes a fabric sheet having a pair of temple straps that are clipped to the sweatband and a pair of neck straps having magnetic fasteners for securing the straps around a wearer's neck. When not needed, the mask can be readily stored within the crown portion interior while the hat is worn, if desired. When needed, the mask is deployed from the hat and the neck straps are secured around the back of the neck to comfortably position the sheet against the wearer's face.

7 Claims, 1 Drawing Sheet

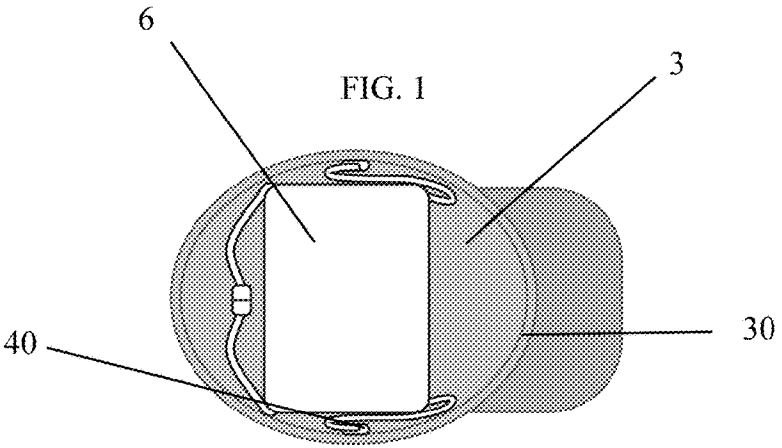
FIG. 1
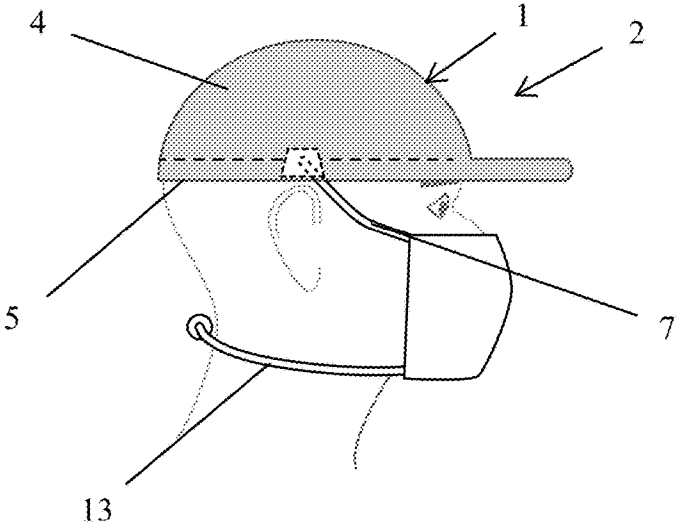
FIG. 2
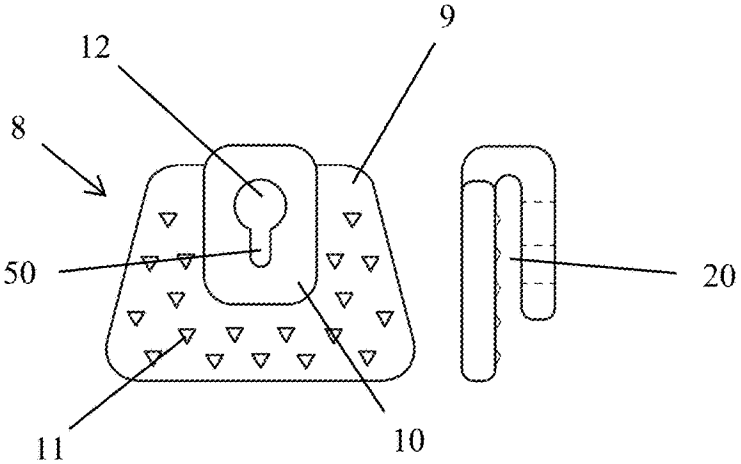
FIG. 4
FIG. 3
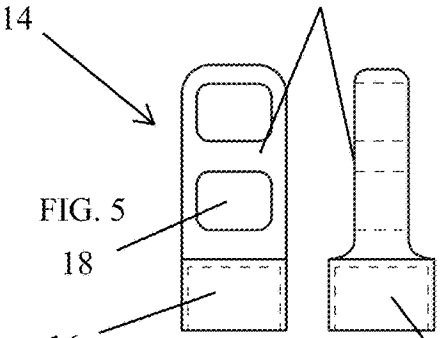
FIG. 7
FIG. 5
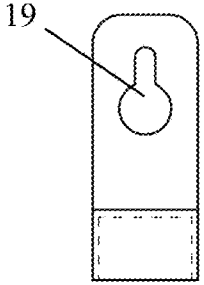
FIG. 6
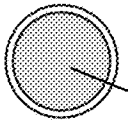
FIG. 8

HAT ATTACHABLE FACE MASK

CROSS REFERENCE TO RELATED APPLICATIONS

This application claims priority of provisional application No. 63/120,507 filed on Dec. 2, 2020, the specification of which is incorporated herein by reference.

BACKGROUND OF THE INVENTION

The present invention relates to a protective face mask that is conveniently attachable to and stowable within a hat or cap.

DESCRIPTION OF THE PRIOR ART

When a person speaks, sneezes or coughs, saliva and mucous droplets are projected to the surrounding atmosphere, which are easily inhaled by those nearby. Therefore, a person with a contagious disease can infect a multitude of people during routine interaction. Furthermore, healthcare workers typically wear medical masks and similar face coverings during certain medical procedures to minimize disease transmission. Masks are also worn in certain construction and industrial applications to minimize exposure to dust, debris, and similar airborne contaminants.

During a pandemic or epidemic, the risk of disease transmission is particularly high whenever a person is in public. For example, due to the recent Covid-19 pandemic, many jurisdictions are mandating that all individuals wear masks or other face coverings whenever they leave their dwellings. However, due to the novelty of mask requirements, remembering to bring a face mask in addition to other personal items is challenging. If a person fails to wear a mask when visiting certain establishments, he or she may be denied entry and must return home to retrieve the mask, or purchase another, which is aggravating and inconvenient. Furthermore, conventional masks have attachment bands that uncomfortably compress the mask against the face. Moreover, they are secured with elastomeric attachment straps that tightly encircle and irritate the ears. As a result, many simply ignore mask mandates, which places them and others at a much greater risk of spreading or contracting infectious diseases.

Accordingly, there is currently a need for a device that makes a face mask more readily available. The present invention satisfies this need by providing a face mask that is easily securable to a hat or cap to facilitate deployment, transport, and storage.

SUMMARY OF THE INVENTION

The present invention relates to a face mask that is easily securable to and stored within a hat or cap to eliminate the burden associated with separately transporting both items. Conventional hats or caps include a crown portion with a sweatband circumferentially disposed on the inner surface. The face mask includes a fabric sheet having a pair of temple straps that are clipped to the sweatband and a pair of neck straps having magnetic fasteners for securing the straps around a wearer's neck. When not needed, the mask can be readily stored within the crown portion interior while the hat is worn, if desired. When needed, the mask is deployed from the hat and the neck straps are secured around the back of the neck to comfortably position the sheet against the wearer's face.

It is therefore an object of the present invention to provide a combination hat and mask that eliminates the aggravation associated with separately transporting both items.

It is therefore another object of the present invention to provide a hat having a deployable face mask that can be discreetly stowed when not in use.

It is therefore yet another object of the present invention to provide a hat having a deployable face mask that is more comfortable than conventional surgical masks.

Other objects, features, and advantages of the present invention will become readily apparent from the following detailed description of the preferred embodiment when considered with the attached drawings and the appended claims.

BRIEF DESCRIPTION OF THE DRAWINGS

FIG. 1 is a lower, plan view the face mask according to the present invention secured to and stowed within a baseball cap.

FIG. 2 is a side view of cap and face mask being worn by a user.

FIG. 3 is a plan view of an exemplary clip for attaching the face mask to the cap sweatband.

FIG. 4 is an isolated, side view of the sweatband clip.

FIG. 5 is an isolated, front view of a neck-strap fastener.

FIG. 6 is an isolated, front view of a second embodiment of the neck-strap fastener according to the present invention.

FIG. 7 is an isolated, side view of the neck-strap fastener.

FIG. 8 is a bottom view of the neck-strap fastener.

DESCRIPTION OF THE PREFERRED EMBODIMENT

The present invention relates to a facemask that is conveniently securable to and stowable within a hat or cap to eliminate the burden associated with separately transporting both items. Referring specifically to FIGS. 1 and 2, a baseball style cap 2 is depicted having a crown portion 1 for covering a wearer's head including an interior surface 3, an exterior surface 4, and a continuous lower rim 5. Circumferentially disposed on the inner surface, near the rim, is a sweatband 30. Though a baseball style cap is depicted and described herein, the mask according to present invention is securable to virtually any style cap or hat.

The face mask 6 includes a fabric sheet having an upper edge, a lower edge, a pair of side edges, a front surface, and a rear surface. The sheet is preferably contoured, concave and/or pliable to comfortably conform to a user's face. A pair of temple straps 7 extend from the upper edge of the sheet to fasten the facemask to the hat or cap. The distal end of each temple strap 7 is removably secured to the sweatband with a clip 8 including a panel 9 having an overhanging flap 10 spaced therefrom. The void 20 between the flap and panel forms a slot that is dimensioned and configured to firmly receive the sweatband 30. An inner surface of the panel includes protrusions 11 or texturing for frictionally engaging the sweatband 30 to prevent the clip from sliding. The flap 10 includes a keyhole 12 or similar opening for receiving a knot 40 at the end of the temple strap. The knot is slid downwardly into a slit 50 to secure the strap to the clip.

The mask is secured over the wearer's face with a pair of neck straps 13 extending from the lower edge of the sheet. A magnetic fastener 14 at the distal end of each neck strap includes a post 15 having a cup 16 at an end thereof with a magnet 17 received therein. The post includes apertures 18, keyholes 19, or similar openings for tying the neck straps to the fastener. A fastener on one strap includes a magnet with a predetermined polarity while the fastener on the other strap includes a magnet having a polarity opposite the predetermined polarity so that the two fasteners readily join when in close proximity. Conventional masks with elastomeric ear loops can be used as well by cutting the ear loops into two separate straps to form a neck strap and a temple strap.

When not needed, the mask can be readily stored within the crown portion interior while the hat or cap is worn, if desired. When needed, the mask is deployed from the hat and the neck straps are secured around the back of the neck to comfortably position the sheet against the wearer's face.

The above-described device is not limited to the exact details of construction and enumeration of parts provided herein. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a headwear item having a crown portion for covering a wearer's head, said crown portion having an interior surface, an exterior surface, a continuous lower rim, and a sweatband disposed on the interior surface, a face mask comprising:

a sheet having an upper edge, a lower edge, a pair of side edges, a front surface and a rear surface;

a pair of temple straps extending from the upper edge of the sheet;

means for attaching a distal end of each of said temple straps to said sweatband;

a pair of neck straps extending from the lower edge of the sheet for securing said sheet over a wearer's face;

a magnetic fastener at a distal end of each of said neck straps, wherein said magnetic fastener includes a post having a cup at an end thereof with a magnet received therein for joining said neck straps around a wearer's neck.

2. The combination according to claim 1 wherein said post includes an opening for tying the neck straps to the magnetic fastener.

3. The combination according to claim 2 wherein the magnet on one of said neck straps has a predetermined polarity and the magnet on another of said neck straps has a polarity opposite the predetermined polarity so that the two fasteners readily join when in close proximity.

4. The combination according to claim 3 wherein said means for attaching a distal end of each of said temple straps to said sweatband comprises a clip.

5. The combination according to claim 4 wherein said clip comprises:

a panel;

a flap attached to said panel;

a void formed between said flap and said panel that is dimensioned and configured to receive said sweatband.

6. The combination according to claim 5 wherein said panel includes a textured inner surface for frictionally engaging said sweatband.

7. The combination according to claim 6 wherein said flap includes an opening to which an end of the temple strap is secured.

* * * * *